United States Patent [19]

Grosshauser

[11] 4,412,490

[45] Nov. 1, 1983

[54] PAPER WEB GUIDING MECHANISM

[75] Inventor: Heinrich K. Grosshauser, Würzburg, Fed. Rep. of Germany

[73] Assignee: Koenig & Bauer AG, Wurzburg, Fed. Rep. of Germany

[21] Appl. No.: 341,027

[22] Filed: Jan. 20, 1982

[30] Foreign Application Priority Data

Feb. 10, 1981 [DE] Fed. Rep. of Germany ..... 3104562

[51] Int. Cl.[3] ..... B41F 5/04

[52] U.S. Cl. ..... 101/219; 101/180

[58] Field of Search ..... 101/228, 417, 420, 213, 101/219, 232, 132, 135, 136, 137, 138, 153, 156, 173, 174, 175, 176, 177, 178, 179, 180, 181, 216, 217, 218, 220–227, 229; 242/76

[56] References Cited

U.S. PATENT DOCUMENTS

| | | | |
|---|---|---|---|
| 1,164,968 | 12/1915 | Turck | 101/180 |
| 1,774,078 | 12/1928 | Belluche et al. | 101/174 |
| 1,959,371 | 5/1934 | Lamatsch | 101/220 |
| 2,181,690 | 11/1939 | Boyd | 101/216 |
| 2,368,341 | 1/1945 | Zuckerman | 101/420 X |
| 2,542,867 | 2/1951 | Harrold | 101/177 X |
| 2,910,937 | 11/1959 | Hirschey | 101/228 |
| 3,112,695 | 12/1963 | Seel | 101/177 |
| 3,185,616 | 5/1965 | Zernov et al. | 101/228 X |
| 3,288,060 | 11/1966 | Miller | 101/153 |
| 3,344,740 | 10/1967 | Hilton | 101/228 |
| 4,325,301 | 4/1982 | Grosshauser | 101/228 X |

FOREIGN PATENT DOCUMENTS

| | | | |
|---|---|---|---|
| 1267228 | 6/1968 | Fed. Rep. of Germany | 101/177 |
| 2741596 | 3/1978 | Fed. Rep. of Germany | 101/228 |
| 2652977 | 5/1978 | Fed. Rep. of Germany | 101/153 |
| 654777 | 3/1979 | U.S.S.R. | 182/91 |

*Primary Examiner*—Edgar S. Burr
*Assistant Examiner*—John A. Weresh
*Attorney, Agent, or Firm*—Jones, Tullar & Cooper

[57] ABSTRACT

A paper web guiding mechanism for printing units in a rotary web-fed printing machine is disclosed. Each printing unit has associated therewith a pivotable paper web guide frame which is comprised generally of spaced side plates. Each side plate is rotatably secured at its lower end to a longitudinal support member of the printing unit so that the paper guide frame can be pivoted between inclined and vertical positions. Paper guide rollers are held between the spaced side plates at the upper and lower ends of the paper guide frame to define a path of paper web travel. A cover sheet extends between the side plates from their upper ends downwardly to a point above the lower ends. This cover sheet supports the body of a press operator who is thus afforded access to various components of the printing units without necessitating severing of the paper web. An operating floor pedestal is placed between the lower ends of the side plates and the press operator can stand on this pedestal.

3 Claims, 1 Drawing Figure

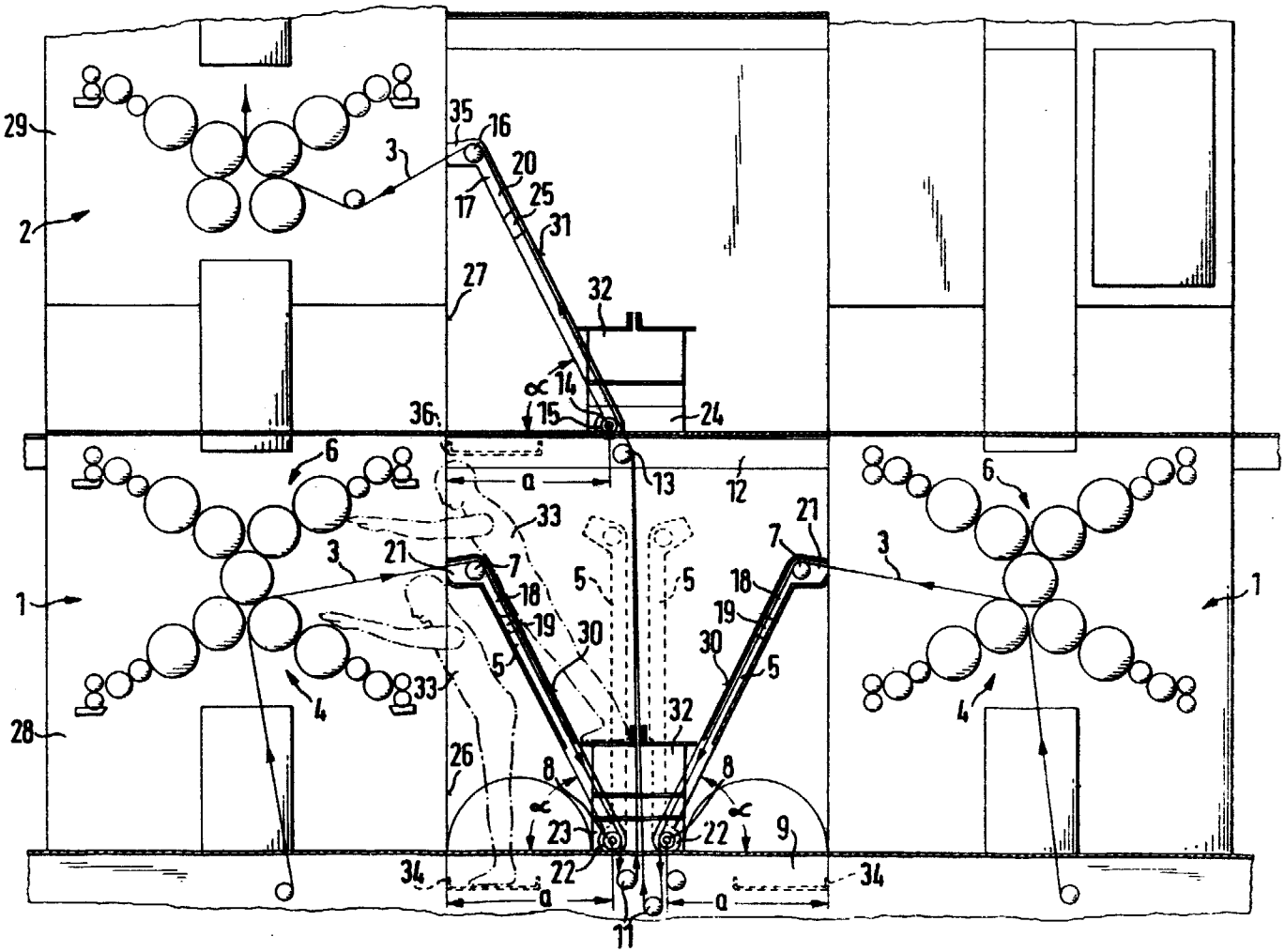

PAPER WEB GUIDING MECHANISM

FIELD OF THE INVENTION

The present invention is directed generally to a paper web guiding mechanism for use with a printing unit in a web fed rotary printing machine. More particularly the present invention is directed to a pivotably mounted paper web guide which also provides support for a press operator. Most specifically, the present invention is directed to a paper web guiding mechanism which affords access to the various printing couples in the printing unit without the necessity of cutting the web off. The paper web is fed generally vertically upwardly into the printing couple or couples of the printing unit and exits generally horizontally to the paper web guide mechanism in accordance with the present invention. The guide mechanism includes spaced side plates that form a paper guide frame to which are several suitable paper web guide rollers. Lower ends of the side plates are pivotally secured to a support member of the press frame and ends of the side plates can be detachably secured to side frames of the printing units. The paper guide mechanism can be pivoted about its lower end between inclined and vertical portions so that a press operator can be supported by the guide mechanism or can move it out of the way. Thus access is afforded to the various printing couples without severing the paper web.

DESCRIPTION OF THE PRIOR ART

A vertically moveable paper guide roller carriage is disclosed generally in German Patent Application No. 2741596. This assembly is used to shift a paper web by means of a guide roller carriage on which a press operator stands during paper web shifting. In a device of this type, the cylinders of the rotary web fed printing press should not be in motion during web shifting for safety reasons. Furthermore, this device does not allow a second press operator to work below the paper guide roller carriage.

A paper web guiding mechanism is disclosed in applicant's U.S. patent application Ser. No. 167,100, filed July 8, 1980, now U.S. Pat. No. 4,325,301 issued Apr. 20, 1982. In this apparatus there are shown spaced shifting bars that are pivotable through about 180° to shift the path of paper web travel between a normal path and a shifted path. This apparatus also includes a press operator support platform that is pivotably carried by the free ends of the spaced shifting bars so that a press operator can stand on the platform when the paper web is in the shifted path. This paper web shifting apparatus provides a platform on which the press operator can stand but does not afford him any body support and is not intended to be used in a situation where it is desirable for a second press operator to work beneath the guide mechanism.

SUMMARY OF THE INVENTION

It is an object of the present invention to provide a paper web guiding mechanism for a printing unit in a rotary web-fed printing machine.

Another object of the present invention is to provide a paper web guiding mechanism which allows the web to be shifted.

A further object of the present invention is to provide a paper web guiding mechanism which affords access to various printing couples in the printing unit without requiring severing of the paper web.

Yet another object of the present invention is to provide a paper web guiding mechanism which provides support for a press operator.

Still a further object of the present invention is to provide a paper web guiding mechanism that allows access to the printing couples by a second press operator.

As will be set forth in greater detail in the description of the preferred embodiment as set forth hereinafter, the paper web guiding mechanism in accordance with the present invention is particularly suited for use with a web-fed rotary printing mechanism having a plurality of printing couples which may be placed one above another. The paper web is fed vertically upwardly into the first couple and exits generally horizontally to the paper web guiding mechanism. This web guiding mechanism is comprised generally of a paper guide frame having a pair of spaced side plates. A lower end of each of the side plates is pivotably secured to a supporting member of the printing unit and an upper end of each side plate is detachably connectable to a side frame of the printing unit. Paper web guide rollers are secured between the side plates at the upper and lower ends and support the paper web. A cover sheet is secured to the side plates and supports the upper body of a press operator so that the operator can have access to the printing couples of the printing unit.

The paper web guide assembly in accordance with the present invention is easily and quickly pivoted between an inclined and a vertical portion without requiring stoppage of the paper web feed. Furthermore, the movement is accomplished with only a slight change in direction of paper web travel so that the change in position of the paper web guide mechanism does not create problems of web breakage and the like. The press operator is also afforded access to the various printing couples in the printing unit without being forced to stand on a moveable platform.

The upper ends of the side plates of the paper web guide frame can be secured to the side frames of the printing machine thus providing rigid support for the paper web guide rollers which are rotatably supported between the side plates. Vibration of the paper guide roller supports and also of the paper guide rollers is thereby avoided.

The paper web guide assembly in accordance with the present invention facilitates rapid and non-destructive web shifting and thus affords access to various press sections. A press operator can be supported by the paper web guide assembly of the present invention and can use the mechanism to reach various printing couples without the necessity of stopping or severing the web. Additionally, a second press operator can have access to another press section at the same time without interfering with web travel or press operation.

BRIEF DESCRIPTION OF THE DRAWING

While the novel features of the paper web guide mechanism for a printing unit in a web-fed rotary printing machine in accordance with the present invention are set forth with particularlity in the appended claims, a full and complete understanding of the invention may be had by referring to the description of a preferred embodiment as set forth hereinafter and as may be seen in the accompanying sole drawing FIGURE which is a schematic side view of a printing unit with portions removed for clarity and showing the paper web guide mechanism in accordance with the present invention.

DESCRIPTION OF A PREFERRED EMBODIMENT

Referring now to the sole drawing FIGURE, there may be seen a pair of printing units 1 and 2 which are situated with printing unit 2 above printing unit 1. A paper web 3 is fed from a supply means (not shown) to printing unit 1 which, in the preferred embodiment is a web-fed offset rotary printing unit having at least one printing couple as does printing unit 2. Paper web 3 is fed vertically upwardly into printing unit 1 and exits between two printing couples which are disposed one above the other; i.e., a lower printing couple 4 and an upper printing couple 6. The paper web is then fed to the upper printing unit 2 by means of a lower paper guide frame, generally at 5 and an upper paper guide frame, generally at 7. The paper web passes sequentially through an upper paper guide roller 7 and a lower paper guide roller 8, carried by lower paper guide frame 5; a paper guide roller 11 supported in a lower longitudinal support member 9 of the lower printing unit 1; a paper guide roller 13 supported in an upper longitudinal support member 12 of upper printing unit 2; and a lower paper guide roller 14 and an upper paper guide roller 16 mounted on the upper paper guide frame 17. It will be understood that rollers 7, 8, 11, 13, 14, and 16 are all mounted in bearings and the like so as to be freely rotatable.

Paper guide frame 5 is comprised of two parallel side plates 18 and 19 which are connected to each other by spaced tranverse cross struts (not shown). Similarly, paper guide frame 17 has two spaced side plates 20 and 25 which are similarly formed by cross struts. The upper ends 21 of side plates 18 and 19 of guide frame 5 are provided with journals to support the upper paper guide roller 7. Similar journals are provided at the lower end 22 of side plates 18 and 19 to support the lower paper guide roller 8. In the same fashion, the upper and lower ends 35 and 15, respectively of the side plates 20 and 25 of the upper paper guide frame 17 are provided with journals that serve to rotatably support rollers 16 and 14.

The lower ends 22 and 15 of lower and upper side plates 18, 19 and 20, 25 of lower and upper paper guide frames 5 and 17, respectively are pivotably supported in bearing blocks 23 or 24 respectively which are, in turn, rigidly secured to the longitudinal support members 9 and 12 of printing units 1 and 2, respectively. Then bearing blocks 23 and 24 are placed a distance "a" to the right of front sides 26 and 27 of side frames 28 and 29 of printing units 1 and 2, respectively, as may be seen in the drawing FIGURE. In the preferred embodiment, distance "a" is about 1.3 meters.

As is shown in the FIGURE, each paper guide frame such as frame 5 can be pivoted or rotated about its lower end 22 in bearing block 23 between a generally vertical portion, as shown in dashed lines, and an inclined portion wherein the upper ends 21 of the side plates 18 and 19 contact the front side 26 of the side frame 28 of printing unit 1. The angle of inclination $\alpha$ as shown in the FIGURE will then be about 65°, this angle being measured between the upper edge of the longitudinal supporting member 9 and the side plates 18 and 19. It will be understood that the angle of inclination will depend on the distance "a" and the length of the side plates 18 and 19. The upper ends 21 of side plates 18 and 19 may be fastened to side 26 of frame 28 by any releasable means such as screws, nuts and bolts, or any quick release fastening means. It will again be understood that the upper ends 35 of side plates 20 and 25 of upper paper guide frame 17 are similarly securable to front side 27 of the side frame 29 of printing unit 2. Similarly, the upper paper guide frame 17 is moveable between inclined and vertical portions through an angle $\alpha$ of, in the preferred embodiment, generally about 65°.

A cover sheet 30 or 31 is attached between the spaced side plates 18, 19, or 20, 25 of paper guide frame 5 or 17, respectively. This cover sheet 30 or 31 is placed on the surface of the side plates away from the printing units 1 and 2. Cover sheet 30 or 31 acts as a supporting surface for the upper body portion of a press operator 33 who can easily reach a printing couple such as couple 6 by leaning against strut 30. Since this sheet is attached to the surfaces of the side plates away from the printing units, the paper web path, defined by rollers 7 and 8 or 14 and 16, is not obstructed by the press operator.

Cover sheet 30 or 31 extends across the width of the paper guide frame, 5 or 17, and extends from the upper end 21 or 35 downwardly to a point approximately 50–60 cms above the lower end 22 or 15, respectively of the paper guide frames. This provides an opening at the lower end of the paper guide frame 5 or 17 which allows the frame to be pivoted between the inclined and vertical portions over an operating floor pedestal 32. When the paper guide frame 5 or 17 is swung into the vertical portion, as shown in dashed lines in the lower portion of the FIGURE, it may be clamped or held in place by suitable means (not shown) which engages the operating floor pedestal 32. Pedestal 32 is rigidly secured to the longitudinal support member 9 or 12 by any suitable means and is located on these supports in such a position that it is on the side of the paper guide frame away from the printing unit 1 or 2 when the guide frame is inclined toward the printing unit. Thus, the pedestal which, in the preferred embodiment, extends between the side plates 18 and 19 or 20 and 25 provides a suitable support for a press operator 33. As the press operator stands on pedestal 32 and rests the upper portion of his body against covering strut 30 or 31, he can have access to elements of the upper printing couple 6 of printing unit 1 so that he can work on the plate cylinder, blanket cylinders, dumping units and the like of the press.

As may also be seen in the drawing, a second press operator 33 may have access to various elements of the lower printing couple 4 under web 3 by standing on a platform 34 or 36 which is attached to the longitudinal support member 9 or 12. The paper guide frame 5 or 17 does not have to be moved from its inclined position, as may be seen in the drawing, for the second press operator to reach printing couple 4. Accordingly, two press operators can work on various portions of the printing unit simultaneously.

While a paper web guiding mechanism for use with a printing unit in a web-fed rotary printing machine in accordance with the present invention has been fully and completely described, it will be obvious to one of skill in the art that a number of changes could be made without departing from the true spirit and scope of the invention. For example the floow pedestal 32 could be removed and hinged footborads could be secured to the side plates or the covering struts. Additional paper guide rollers could also be secured to the side plates of the guide frames, if desired. The specific securement means for the various rollers and the specific journal and bearing means could also be varied. Thus the present invention is to be limited only by the following claims.

I claim:

1. A paper web guiding mechanism for use with a printing unit in a web-fed printing machine to afford access to component parts of printing couples in the printing unit, said paper web guiding mechanism comprising:

a paper guide frame which is capable of being inclined at an angle $\alpha$ againt side frames of the printing unit;

paper guide rollers rotatably secured to upper and lower ends of said paper guide frame, said paper guide rollers defining a path of paper web travel;

an operating floor pedestal secured to the printing machine adjacent said lower end of said paper guide frame; and a cover sheet secured to said paper guide frame on a side of said paper guide frame away from the printing unit.

2. The paper web guiding mechanism of claim 1 wherein said operating floor pedestal is positioned between spaced side plates of said paper guide frame.

3. A paper web guide assembly for a printing unit in a web-fed rotary printing press in which the printing unit may include a plurality of printing couples spaced one above the other, the paper web entering the printing unit generally vertically and exiting the printing unit generally horizontally, said paper web guide assembly comprising:

a paper guide frame pivotably secured to a longitudinal support member of said printing unit, said paper guide frame including spaced parallel side places;

first and second paper guide rollers rotatably secured to upper and lower ends of said paper guide frame and extending between said side plates, said paper guide rollers defining a web travel path in said paper guide frame;

a cover sheet secured to said paper guide frame and extending between said spaced side plates, said cover sheet extending from said upper end of said paper guide frame downwardly and terminating above said lower end of said paper guide frame; and an operating floor pedestal secured to said longitudinal support memeber between said lower ends of said spaced side plates.

* * * * *